US007310845B2

(12) United States Patent
Gilli

(10) Patent No.: US 7,310,845 B2
(45) Date of Patent: Dec. 25, 2007

(54) PUTTY KNIFE MADE OF PLASTIC MATERIAL FOR THE APPLICATION OF SUBSTANCES FOR MURAL COATINGS AND THE LIKE

(75) Inventor: Alberto Gilli, Andezeno (IT)

(73) Assignee: Candis S.R.L., Torino (IT)

( * ) Notice: Subject to any disclaimer, the term of this patent is extended or adjusted under 35 U.S.C. 154(b) by 0 days.

(21) Appl. No.: 11/442,011

(22) Filed: May 26, 2006

(65) Prior Publication Data

US 2006/0265829 A1 Nov. 30, 2006

(30) Foreign Application Priority Data

May 27, 2005 (IT) ..... TO20050069 U

(51) Int. Cl.
*A01K 31/04* (2006.01)

(52) U.S. Cl. ..... 15/93.4; 15/235.4; 15/236.01; 15/235.8; 16/DIG. 24

(58) Field of Classification Search ..... None
See application file for complete search history.

(56) References Cited

U.S. PATENT DOCUMENTS

| | | | | |
|---|---|---|---|---|
| 1,763,066 | A | 6/1930 | Rooney | |
| 5,097,909 | A | 3/1992 | Jauhal et al. | 172/371 |
| 5,333,348 | A | 8/1994 | Schumacher, II et al. | 15/235.4 |
| RE36,463 | E | 12/1999 | Jarvis | 15/235.8 |
| 2002/0073554 | A1 | 6/2002 | Chen | 30/169 |
| 2003/0084545 | A1 | 5/2003 | Cheng | 16/430 |
| 2004/0049873 | A1 | 3/2004 | Smeja et al. | 15/236.05 |

FOREIGN PATENT DOCUMENTS

DE 43 06 564 A1 7/1994

OTHER PUBLICATIONS

European Search Report for EP 06 10 1244.9—2303, dated Aug. 25, 2006.

*Primary Examiner*—David Redding
(74) *Attorney, Agent, or Firm*—Heslin Rothenberg Farley & Mesiti P.C.; Victor A. Cardona, Esq.

(57) ABSTRACT

A putty knife for the application of substances for mural coatings and the like comprising a blade made of plastic material provided with a manoeuvring part formed by a handle made also of plastic material secured to the blade in a rapidly detachable fashion.

3 Claims, 2 Drawing Sheets

PUTTY KNIFE MADE OF PLASTIC MATERIAL FOR THE APPLICATION OF SUBSTANCES FOR MURAL COATINGS AND THE LIKE

CROSS-REFERENCE TO RELATED APPLICATIONS

This application claims priority from Italian Patent Application No. TO2005U000069 filed on May 27, 2005, the entire disclosure of which is incorporated herein by reference.

FIELD OF THE INVENTION

The subject of the present invention is a putty knife made of plastic material for the application of substances for mural coatings and the like, such as for example putty, plasters, decorative paints, etc.

STATE OF THE PRIOR ART

Putty knives of this sort, made by moulding, traditionally comprise a relatively thin spatulate blade formed integrally with a manoeuvring part for being handled by the operator. In use, the blade made of plastic material is subject to wear and also to failure, which requires the replacement of the entire putty knife even quite frequently, with all the costs that this entails.

SUMMARY OF THE INVENTION

The purpose of the invention is to overcome at least partially said drawback.

With a view to achieving said purpose, the subject of the invention is a putty knife of the type defined above, basically characterized in that the manoeuvring part consists of a handle fixed to the blade in a rapidly detachable fashion.

According to a preferred of embodiment of the invention, the blade is formed on one face with a seat in relief, within which is engaged a resting base of a hollow column bearing the handle, which is fixed to the blade via a screw that extends through said column and is screwed within a threaded projection projecting substantially centrally from the aforesaid seat in relief of the blade.

Thanks to this embodiment, the putty knife according to the invention not only has an extremely practical and functional conformation, but above all enables—in the case of wear or failure of the blade—recovery of its functionality by a simple replacement of the blade that is broken or worn out with a new intact blade. The putty knife may thus be possibly offered on sale with a handle and accompanying blades, even of different dimensions and thicknesses, that are interchangeable.

BRIEF DESCRIPTION OF THE DRAWINGS

The invention will now be described in detail with reference to the annexed plate of drawings, which is provided purely by way of non-limiting example and in which.

DETAILED DESCRIPTION OF THE INVENTION

Figure 1:
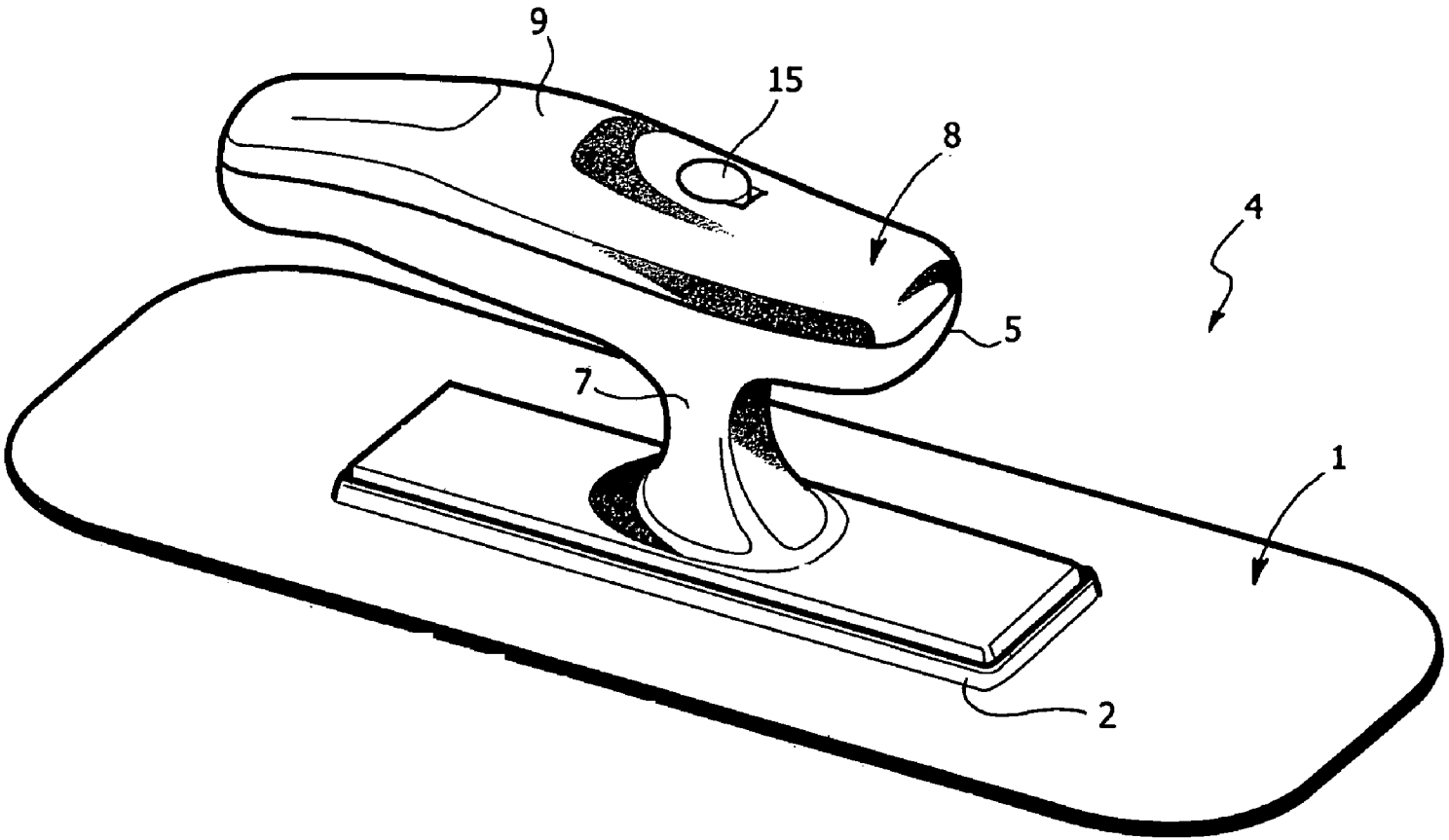
FIG. 1 is a schematic perspective view of a putty knife according to the invention for application of substances for mural coatings.
Figure 2:
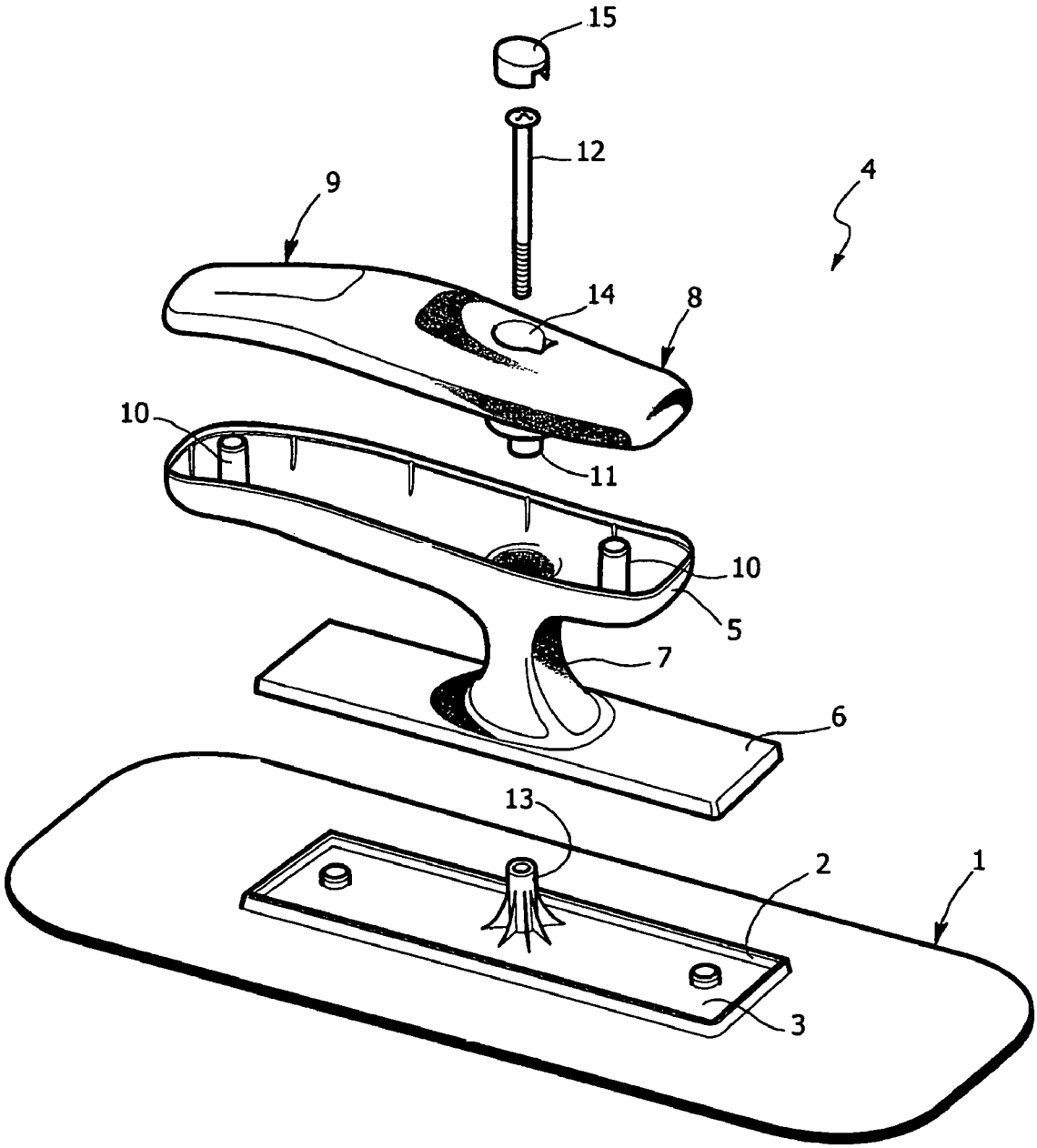
FIG. 2 is an exploded view of the putty knife of FIG. 1.

With reference to the plate of drawings, a putty knife for the application of substances for mural coatings according to the invention basically comprises a blade 1 made of plastic material, having a generally rectangular shape with rounded-off corner edges and chamfered perimetral edge, formed on one face with a rectangular edge in relief 2 that defines a seat 3. Fixed in a detachable way to said face of the blade 1 is a manoeuvring part consisting of a handle 4, which is also made of moulded plastic material. The handle 4 comprises, in a single piece, a first half shell 5 joined to a base plate 6 through a shaped hollow column 7. The base plate 6 has a conformation complementary to that of the seat 3 of the blade 1 and, in the assembled condition represented in FIG. 1, it is engaged with a shape fit within said seat 3, inside the corresponding edge in relief 2.

Set on the first half shell 5 is a second half shell 8, the outer surface of which is coated, typically via overmoulding, with an anti-slip material 9, for example made of a thermoplastic rubber.

The second half shell 8 is joined to the first half shell 5 via slotting elements 10, 11 and by means of a screw 12 inserted through the half shells 8 and 5, as well as through the hollow column 7 and the base plate 6. The threaded end of the screw 12 is screwed within a threaded tubular projection 13 projecting, integrally with the blade 1, from the central area of the seat 3.

In the assembled condition, the head of the screw 12 is set-in in a seat 14 of the second half shell 8, which is conveniently closed via a pressure plug 15.

To separate the manoeuvring part 4 from the blade 1, in order to enable replacement thereof in the case of wear or failure, it is sufficient to remove the plug 15 and then unscrew the screw 12 in an evidently simple and rapid way.

Of course, the details of construction and the embodiments may vary widely with respect to what is described and illustrated herein, without thereby departing from the scope of the present invention as defined in the ensuing claims.

What is claimed is:

1. A putty knife made of plastic material for the application of substances for mural coatings and the like, comprising:

a blade provided with a manoeuvring part consisting of a handle secured to said blade in a rapidly detachable fashion;

said blade having one face formed with a seat in relief, said seat having an outer edge projecting upwardly;

a resting base of a hollow column of said handle engaged with said seat and received within said outer edge, said resting base being connected to said blade; and said handle formed by a first half shell and by a second half shell, said first half shell being formed monolithically relative to said base and said second half shell being connected to said first half shell.

2. The putty knife according to claim 1, wherein said second half shell is coated with an anti-slip material.

3. The knife of claim 1 wherein said outer edge of said seat and an outer surface of said base comprise substantially rectangular shapes.

* * * * *